US009302815B2

(12) United States Patent
Shaw et al.

(10) Patent No.: US 9,302,815 B2
(45) Date of Patent: Apr. 5, 2016

(54) WINE BOTTLE PROTECTION WRAP AND ASSOCIATED MARKETING METHOD

(71) Applicant: HDD, LLC, Healdsburg, CA (US)

(72) Inventors: Kevin Shaw, New York, NY (US); Phillip L. Hurst, Healdsburg, CA (US); Teresa Mengali, Geyersville, CA (US)

( * ) Notice: Subject to any disclaimer, the term of this patent is extended or adjusted under 35 U.S.C. 154(b) by 90 days.

(21) Appl. No.: 13/929,665

(22) Filed: Jun. 27, 2013

(65) Prior Publication Data

US 2014/0097234 A1 Apr. 10, 2014

Related U.S. Application Data

(60) Provisional application No. 61/710,572, filed on Oct. 5, 2012.

(51) Int. Cl.

| | |
|---|---|
| ***B65D 65/00*** | (2006.01) |
| ***B65D 23/08*** | (2006.01) |
| ***B65B 11/54*** | (2006.01) |
| ***B65D 65/04*** | (2006.01) |
| ***G09F 3/02*** | (2006.01) |

(52) U.S. Cl.

CPC ..... *B65D 23/0857* (2013.01); *B65B 11/54* (2013.01); *B65D 23/08* (2013.01); *B65D 65/04* (2013.01); *G09F 3/02* (2013.01); *G09F 2003/0273* (2013.01)

(58) Field of Classification Search

CPC . B65D 23/0842; B65D 59/04; B65D 81/3886
USPC ..... 229/89–92, 87.2, 75; 150/154; 215/386; 220/737, 739; 294/137, 149, 150; 383/35, 67

See application file for complete search history.

(56) References Cited

U.S. PATENT DOCUMENTS

| | | | | |
|---|---|---|---|---|
| 422,366 | A * | 3/1890 | Beale | 229/89 |
| 847,648 | A * | 3/1907 | Carnahan | 229/67.1 |
| 1,126,341 | A * | 1/1915 | Baer | 383/121 |
| 2,081,409 | A * | 5/1937 | Rush | 215/12.1 |
| 2,221,310 | A * | 11/1940 | Gazelle | 428/158 |
| 4,811,896 | A * | 3/1989 | Sohma | 229/89 |
| 5,092,513 | A * | 3/1992 | Arbonies | 229/68.1 |
| D379,303 | S * | 5/1997 | Broye | D9/444 |
| 6,109,787 | A * | 8/2000 | Stary | 383/209 |
| D445,027 | S * | 7/2001 | Sherts et al. | D9/444 |
| 6,290,091 | B1 * | 9/2001 | Bell | 220/739 |
| 6,513,704 | B1 * | 2/2003 | Perot | 229/104 |
| 6,718,733 | B2 | 4/2004 | Kilmartin | |
| 7,828,195 | B2 | 11/2010 | Edmondson | |
| 2003/0075549 | A1 * | 4/2003 | O'Brien et al. | 220/739 |
| 2006/0283868 | A1 * | 12/2006 | McDonald | 220/737 |
| 2008/0017654 | A1 * | 1/2008 | Chu | 220/739 |
| 2008/0217388 | A1 * | 9/2008 | Brayshaw | 229/89 |
| 2009/0090642 | A1 * | 4/2009 | Trimarco | 206/139 |
| 2009/0090732 | A1 * | 4/2009 | Trimarco | 220/739 |
| 2009/0242578 | A1 * | 10/2009 | Bonilla | 220/739 |
| 2012/0125986 | A1 * | 5/2012 | Walton | 229/87.05 |

* cited by examiner

*Primary Examiner* — Jes F Pascua
(74) *Attorney, Agent, or Firm* — LaRiviere, Grubman PC

(57) ABSTRACT

A wine bottle wrap for promoting the contents of the bottle, the brand, or the entity that produced or is presenting the bottle for sale. The wine bottle wrap is generally made of paper, sized and shaped to be easily wrapped around a bottle, such as a wine bottle. The paper will include printed words and drawings or other images that can both identify the contents of the bottle and provide other marketing material. In a preferred embodiment, at least some of the bottle is visible in a gap in the wrap, preferably at the bottom of the bottle.

8 Claims, 5 Drawing Sheets

WINE BOTTLE PROTECTION WRAP AND ASSOCIATED MARKETING METHOD

CROSS-REFERENCE TO RELATED APPLICATIONS

The present application claims the priority of U.S. Provisional Patent Application Ser. No. 61/710,572, entitled "Wine Bottle Protection Wrap And Associated Marketing Method", filed Oct. 5, 2012, which application is incorporated in its entirety herein by reference.

BACKGROUND OF THE INVENTION

Wine bottle wrappers and packaging devices are known in the art. For instance, a wine bottle sleeve is disclosed in Edmondson (U.S. Pat. No. 7,828,195 B2) and Kilmartin (U.S. Pat. No. 6,718,733). Further, simple paper bags have been routinely used, typically after purchase, to package and transport wine bottles. However, what has been lacking in the field is a simple, inexpensive way to wrap and protect wine bottles before sale in a way that allows the seller of the wine to protect the wine bottles and promote/advertise on the wrap, while at the same time allowing the consumer to view at least a portion of the actual bottle. The invention described herein utilizes a band that spans the bottom of the bottle, but allows gaps on either side of the band to allow the consumer to view the original bottle and its contents without removing the wrap. The bottom band also improves the stability of the wrap on the bottle during handling.

BRIEF SUMMARY OF THE INVENTION

The wine wrap is used to provide an easy and effective way to market, promote or advertise either the contents of the bottle, the brand, or the entity that produced or is presenting the bottle for sale. The wine wrap is generally made of paper, sized and shaped to be easily wrapped around a bottle, such as a wine bottle. The paper may include printed words and drawings or other images that can both identify the contents of the bottle and provide other marketing or promoting material. In a preferred embodiment, at least some of the bottle is visible in a gap in the wrap, preferably at the bottom of the bottle.

The wine wrap includes a paper bag, sized and shaped to accommodate a bottle, such as a wine bottle. Preferably, the bag has at least one gap in the bottom of the bag to allow the user to see the contents of the bottle. For instance, the bottom of the bag may constitute a strip of paper across the middle of the bottle that forms a gap or open section on both sides of the strip that allows the user to determine the color and other attributes of the liquid in the bottle. The top of the wrap (at the neck of the bottle) is preferably secured to the bottle via an elastic band as shown in the drawings.

The wrap is placed around the bottle so that it covers or encircles some or the entire bottle. The top of the wrap is secured to the bottle via an elastic band or other similar device. Ideally, the wrap is secured in a semi-permanent fashion that precludes the user from removing the wrap until after purchase. The wrap will include words, drawings, and/or images to assist in the marketing or promotion of the product.

A variety of different types of paper can be used, including coated or uncoated paper. Coated papers are less absorbent (or have a greater ink holdout) than uncoated papers. Greater ink holdout can result in more vibrant color printing; however, it may be necessary to allow for extra drying time for the ink to avoid smears. Paper with a clay or other coating applied to one or both sides is coated paper. The coating can be dull, gloss, matte, or other finishes. Coated paper generally produces sharper, brighter images and has better reflectivity than uncoated paper. For that reason, coated papers will be the preferred embodiment in most situations.

Coated paper typically is smoother and has better ink holdout (i.e. is less absorbent) than uncoated paper making it more suitable for certain types of overprint finishing techniques such as flood or spot coating with varnish or other finish coatings. The coating may be applied while the paper is still going through the papermaking machine or it may be applied afterwards. Clay, latex, and other substances are mixed to create the coating. Photo papers for inkjet printing typically have UV coatings.

Although wine bottles in paper bags are well known, this tight fitting configuration is easily grasped by a shopper or other handler, and may have marketing or promotion type material printed on the wrap. The wrap is attached to the bottle near the top and having open sections on the bottom, which is new and non-obvious.

The advantages of the wrap include a way to provide a new venue for marketing or promoting material before, during, and after the sale of the product (since the wrap will not be removed until after purchase). The paper wrap also:

i. protects the contents of the bottle from direct sunlight (which may affect the taste of the product);
ii. insulates the contents of the bottle by providing a barrier to temperature changes; and
iii. provides some protection to the bottle itself during transportation.

DETAILED DESCRIPTION OF THE DRAWINGS

Figure 1:
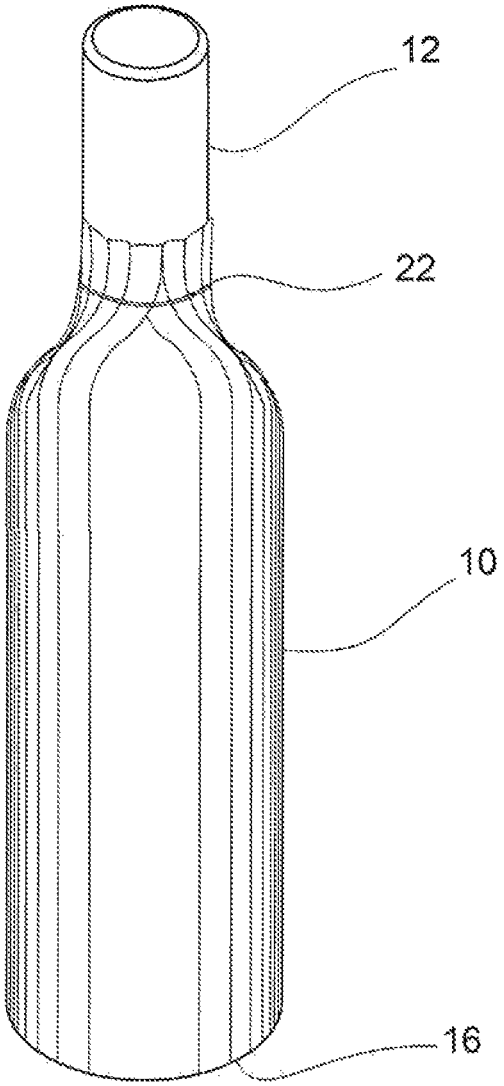
FIG. 1 shows a perspective view of the invention, with the wrap covering a bottle.

FIG. 1 shows a perspective view of the invention, with the wrap 10 covering or encircling bottle 12. The wine wrap 10 is shown with colorful and distinctive writing and images. In this example, the writings indicate the contents of the bottle (e.g. 2011 white wine from California) as well as other marketing and promotional writings and images. The wrap 10 is secured to the bottle 12 with an elastic band 22 near the top of wrap at the neck of the bottle 12. The wrap 10 can be secured to the bottle in a variety of ways, including where the wrap 10 is pre-formed and shaped into a cylinder shape, with the bottom strip 18 attached to the wrap 10 and spanning the circular area at the bottom, then inserting the bottle into the cylinder shaped wrap, and securing the top of the wrap with the elastic band.

In an alternative embodiment, the wrap could be taken from a (pre-cut) flat sheet of paper, then wrapped around the bottle, then affixing the sides of the wrap to each other, snug to the bottle, then affixing the side tabs and bottom strip to secure the bottom of the wrap, and affixing the elastic band around the wrap at the neck of the bottle to secure the top of the wrap.

It should be noted that these different processes may be done in a different order than those described above, and should not limit the scope of the invention.

Figure 2:
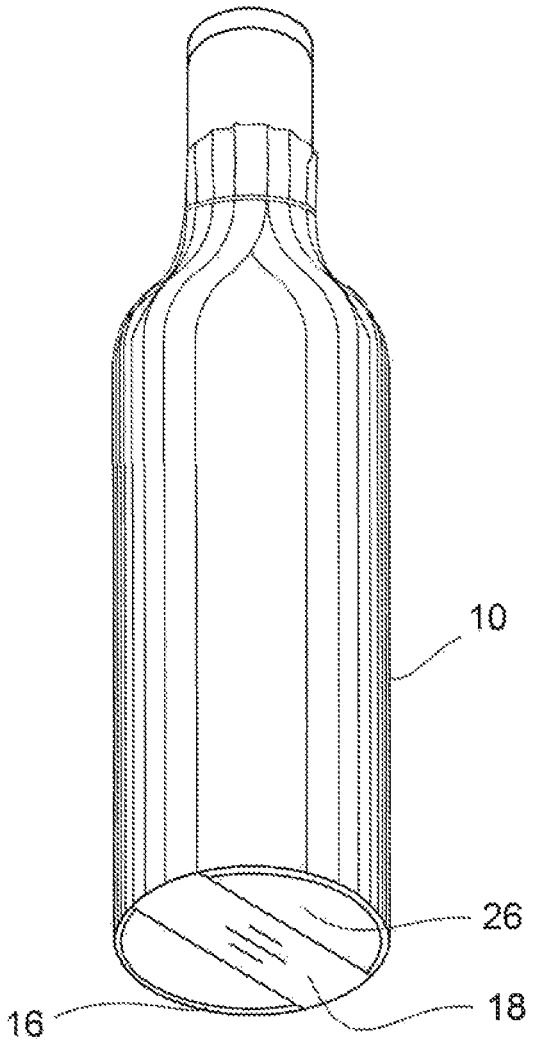
FIG. 2 shows a perspective view of the invention, with the wrap covering or encircling a bottle and showing the bottom strip.

FIG. 2 shows a perspective view of the invention, with the wrap 10 covering or encircling bottle 12 and showing the bottom strip. The bottom strip 18 is shown spanning the bottom 16 of the bottle. The gap 26 between the main section of the wrap 10 and the bottom strip 18 allows the bottle 12 and its contents to be viewed prior to purchase, without removing the wrap 10.

Figure 3:
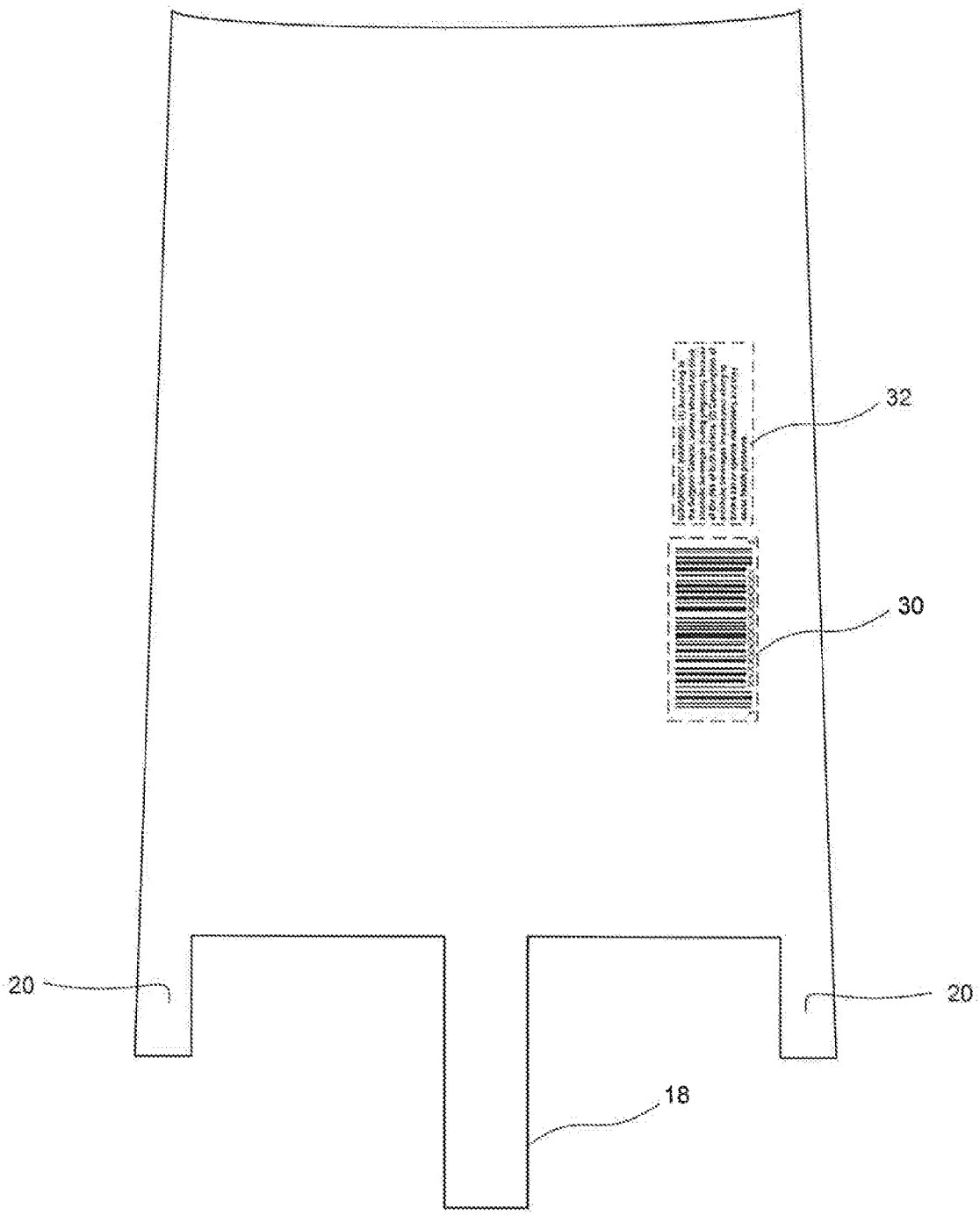
FIG. 3 shows a front view of an embodiment of the invention.

FIG. 3 shows a front view of an embodiment of the invention. The wrap 10 is shown, including the side tabs 20 and bottom strip 18. In a preferred embodiment, the side tabs 20 overlap each other when wrapped around a bottle 12, and the bottom strip 18 attaches to the side tabs (preferably with an adhesive) to secure the bottom of the bottle 16. Also shown are the bar code 30 and the required governmental warning 32 regarding products containing alcohol.

Figure 4:
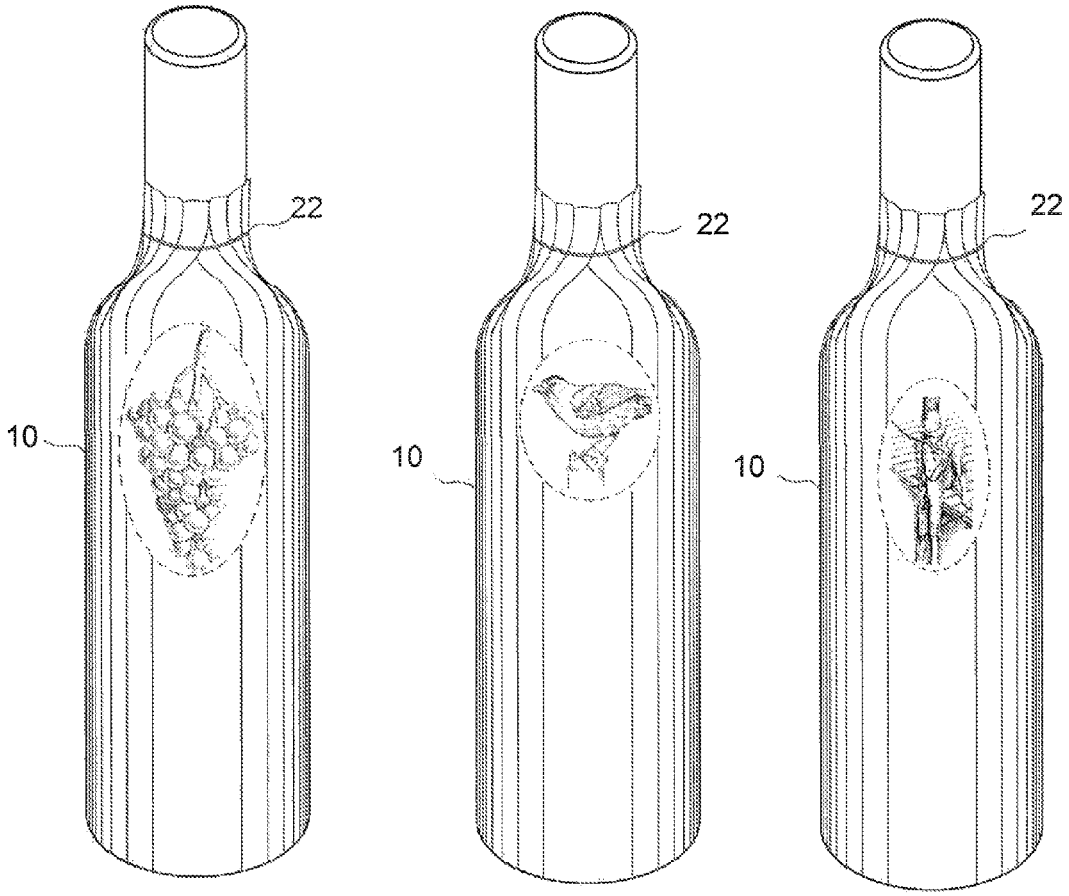
FIG. 4 shows a front view of three examples of invention, with the wraps covering or encircling three bottles.

FIG. 4 shows a front view of three examples of invention, with the wraps 10 covering or encircling three bottles. The elastic band 22 secures the top of the wrap near the top of the bottle. FIG. 4 illustrates the large variety of different colorful writings and images that can be used on the wraps in an effort to create distinctive appearances. These distinctive looks are used in the method of marketing and/or promoting described and claimed herein.

Figure 5:
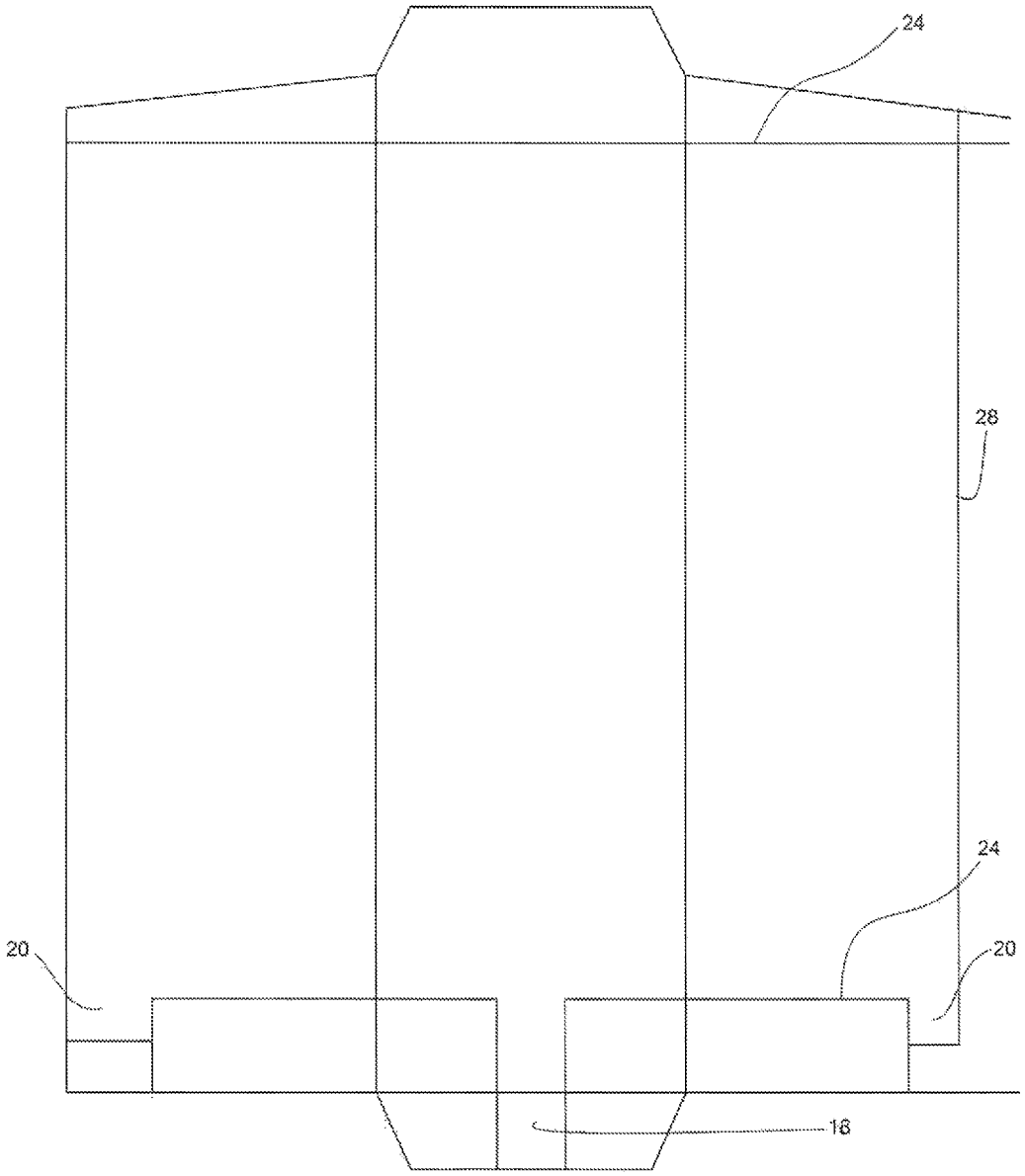
FIG. 5 shows a section of paper with trim lines and ink holdout lines.

FIG. 5 shows a section or paper with trim lines 24 and ink holdout lines 28 shown. The trim lines 24 are shown to illustrate the locations on the paper where cuts are to be made to fit the paper to the bottle 12 properly. The ink holdout lines illustrate where on the paper the printing (preferably on the other side of the paper) is to end. The side tabs 20 are also shown, along with the bottom strip 18.

We claim:

1. A paper wrap comprising:

a main wrap body having distinctive advertising content and writings thereon describing the contents of the bottle or the brand, or the seller thereof for wrapping around a bottle before sale;

the main wrap body further includes trim lines illustrating locations on the paper where cuts are to be made for properly fitting the paper wrap around the bottle; and the paper wrap further including a bottom section, having a bottom strip and tabs disposed at opposite sides thereof, attached to the main wrap body and defined by the trim lines, wherein the bottom strip and tabs are to form an opening between the bottom section and the main wrap body after the main wrap body has been cut along the trim lines and the main wrap body is wrapped around the bottle to allow inspection of the contents of said bottle without removal of the main wrap body.

2. A paper wrap comprising:

a main wrap body for wrapping around a bottle before sale, the wrap having distinctive advertising content and writings thereon describing the contents of the bottle or the brand or the seller thereof, the bottle having a neck;

the main wrap body further including trim lines illustrating locations on the paper where cuts are to be made for properly fitting the paper wrap on the bottle;

the paper wrap further including a bottom section having side tabs and a bottom strip attached to the main wrap body and defined by the trim lines where the tabs and bottom are to form an opening between the bottom section and the main wrap body has been cut along the trim lines and the main wrap body is wrapped around the bottle for inspection of the contents of said bottle without removal of the main wrap body; and a securing element for securing a top portion of the paper wrap to the neck of the bottle.

3. A paper wrap according to claim 2, wherein the securing element is an elastic band.

4. A paper wrap according to claim 2 wherein the bottom strip spans the bottom of the bottle.

5. A paper wrap according to claim 2, wherein the main wrap body includes fanciful writings and images.

6. A paper wrap according to claim 2, wherein the bottle is a wine bottle.

7. A method for promoting the contents of a bottle using a paper wrap having a distinctive look and a bottom section, the bottle having a main body, a neck, and a bottom, the method comprising the steps of:

marking illustration locations on the paper wrap where cuts are to be made;

cutting out the marked illustration locations on the paper wrap for properly fitting the paper wrap on the bottle;

wrapping the main body of the bottle with a main wrap section;

securing the wrap to the neck of the bottle using an elastic band;

spanning the bottom of said bottle with a bottom section of the wrap, and forming a gap between the paper wrap and the bottom section of the paper wrap for inspecting the contents of the bottle, without removal of said wrap.

8. The method according to claim 7, wherein the main wrap section further includes fanciful writings and images.

* * * * *